US005236886A

United States Patent [19]

Tsuchiya et al.

[11] Patent Number: 5,236,886

[45] Date of Patent: Aug. 17, 1993

[54] THERMAL TRANSFER IMAGE-RECEIVING ELEMENT

[75] Inventors: Masaru Tsuchiya; Keiji Ohbayashi, both of Hino, Japan

[73] Assignee: Konica Corporation, Japan

[21] Appl. No.: 718,019

[22] Filed: Jun. 20, 1991

[30] Foreign Application Priority Data

Jun. 25, 1990 [JP] Japan ..... 2-166121

[51] Int. Cl.[5] ..... B41M 5/035; B41M 5/38

[52] U.S. Cl. ..... 503/227; 428/195; 428/412; 428/480; 428/483; 428/522; 428/913; 428/914; 430/201; 430/203; 430/213

[58] Field of Search ..... 8/471; 428/195, 412, 428/500, 913, 914, 480, 483, 522; 503/227; 430/201, 203, 213

[56] References Cited

FOREIGN PATENT DOCUMENTS 3-079391 4/1991 Japan ..... 503/227

*Primary Examiner*—B. Hamilton Hess

*Attorney, Agent, or Firm*—Jordan B. Bierman

[57] ABSTRACT

A thermal transfer recording material improved in adhesion of an image-receiving layer to a support comprises an image-receiving element comprising a support having a subbing layer and an image-receiving layer provided thereon in this sequence, said subbing layer containing a hardener.

9 Claims, No Drawings

THERMAL TRANSFER IMAGE-RECEIVING ELEMENT

FIELD OF THE INVENTION

The present invention relates to a thermal transfer image-receiving element, more specifically to a thermal transfer image-receiving element which can be employed in combination with a melting-type thermal image-transferring element, an evaporation-type thermal image-transferring element and a heat-processable light-sensitive material.

BACKGROUND OF THE INVENTION

Various methods have been employed to produce a visual image by heat treatment. For instance, as described in "Modern Hard Copy Printer Technology", Imaging, Part 2, special edition of Photographic Industry (Shashin Kogyo Shuppan Sha, Jul. 20, 1988), pp 63–113, an image can be produced and transferred to recording paper by the so-called thermal transfer method in which a sheet of recording paper is laid on top of a thermal transfer ribbon having a support and provided thereon a layer comprising a binder with a dye or a pigment dispersed therein, and thermal energy corresponding to image information is supplied by a thermal head from the backside of the thermal transfer ribbon, thereby allowing an image to be transferred and recorded on the recording paper.

Also known is the heat-processing method in which an image, either monochromatic or colored, is formed by exposing a silver halide light-sensitive material to light, followed by heat-processing. Details of this method are described in the summary of the 17th symposium of Japan Photographic Society, "A study of heat-processable silver salt recording system", May 1987. In the heat processing method, a silver or dye image is produced by subjecting a heat-processable light-sensitive material comprising a light-sensitive silver halide, a binder and a reductant to imagewise exposure to light, followed by heating and pressing. A dye image formed by this process is transferred to an image-receiving element, the image-receiving element is removed from the light-sensitive material, forming a vivid dye-image.

The above thermal image transfer method and the heat-processing method have an advantage over conventional wet processing as they require no liquid processing, but have such a defect that adhesion between a support and an image-receiving layer tends to lower during image-forming performed at a high temperature.

Baryta paper, art paper, polyethylene-coated paper, plastic films and others have been employed as the support for an image-receiving element. These conventional supports, however, exhibit poor adhesion to an image-receiving layer.

Meanwhile, plastic films, due to their improved surface luster, surface smoothness and transparency, have come to be employed more widely than ever as the support, since they are suited to image appreciation using a transmitted light, such as image appreciation by OHP, and can satisfy a recent demand for a high image quality. Of such plastic films, films of polyester resins, in particular, polyethylene terephthalate, have been employed most widely. However, an image-receiving element prepared by providing an image-receiving layer directly on a polyethylene terepthalate film encounters such a problem that the image-receiving layer tends to peel off from the support during heat treatment for the formation and transfer of an image. The removal of an image-receiving layer from a support may result in ununiform developing. In addition, in such image-receiving element, removal of an image-receiving layer from a support may occur even after an image is transferred thereonto, which significantly impairs the commercial value of the image-receiving element.

SUMMARY OF THE INVENTION

The present invention has been made with the above circumstances taken into consideration. Therefore, the object of the invention is to provide a thermal transfer image-receiving element of which the image-receiving layer hardly peels off from a support, and therefore, permits uniform development to produce a high quality image.

The above object has been attained by an image-receiving element for receiving a dye image formed or released by heating, wherein said element has a support and at least one subbing layer and at least one image-receiving layer provided thereon in this sequence, and said subbing layer contains a hardener.

In a preferred embodiment of the invention, the image-receiving element is employed in the heat processing method in which an image is produced or released by exposing to light a heat-processable light-sensitive material having a support and provided thereon, at least, a light-sensitive silver halide, a reductant, a binder and a dye providing material, followed by heating.

The present invention will be described in detail.

The image-receiving element of the invention has a support and at least one subbing layer and at least one image-receiving layer provided thereon in this sequence. The image-receiving layer is a layer which receives and fixes an image transferred by heating.

The subbing layer according to the invention contains at least a binder resin and a hardener. Due to the co-presence of a binder resin and a hardener, the subbing layer is hardened by a polymeric reaction such as polymerization, condensation and cross-linking. Such polymeric reaction can be accelerated by the action of light, heat or electron rays.

Examples of the binder resin employed in the invention include vinyl acetate resins, ethylene-vinyl acetate resins, acrylic resins, vinyl acetate-acrylic acid resins, cyanoacrylate resins, vinyl chloride resins, vinylidene chloride resins, polyvinyl alcohol resins, polyvinyl acetal resins, polyamide resins, polyolefin resins, cellulose resins, polyester resins, polyurethane resins, urea resins, melamine resins, phenol resins, epoxy resins, xylene resins, silicone resins, nitrile resins and copolymers of these resins.

Of them, preferred are acrylic resins, cyanoacrylate resins, polyester resins, polyurethane resins, vinyl chloride resins, nitrile resins and their copolymers.

The amount of the binder resin is preferably 0.01 to 20 g, more preferably 0.05 to 10 g, per square meter of the subbing layer.

Examples of the hardener employed in the invention include acid anhydride hardeners, mineral acid or acid hardeners, peroxide hardeners, polyfunctional vinyl hardeners, aldehyde hardeners, metal salt hardeners, silane hardeners, aziridine hardeners, isocyanate hardeners, ethyleneimine hardeners, polyamine hardeners, epoxy hardeners, melamine hardeners and urea hardeners. Of them, preferred are ethyleneimine hardeners, isocyanate hardeners, epoxy hardeners and methanesulfone hardeners, the specific examples of which are described in U.S. Pat. Nos. 2,726,162, 2,816,125, 2,964,404, 2,983,611, 3,103,437, 3,220,848, 3,271,175, 3,392,024, German Patent Nos. 1,081,169, 1,085,663, British Patent No. 918,950, Japanese Patent Publication Open to Public Inspection (hereinafter abbreviated as Japanese Patent O.P.I. Publication) No. 257564/1964, "Epoxy Resin", A Course for Plastic Materials, Vol. 1 (Nikkan Kogyo Shinbunsha), "Polyurethane Resin", A Course for Plastic Materials, Vol. 2 (Nikkan Kogyo Shinbunsha), and Encyclopedia of Adhesion (Asakura Shoten). Most preferred are ethyleneimine hardeners, isocyanate hardeners and epoxy hardeners.

The following are the specific examples of the hardener preferably employed in the invention, which, however, should not be construed as limiting the scope of the invention.

Example compound (H-1)

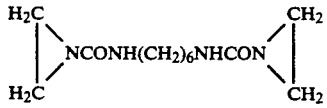

(H-2)

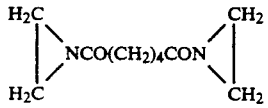

(H-3)

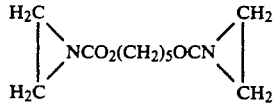

(H-4)

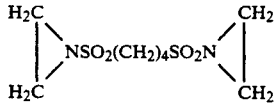

(H-5)

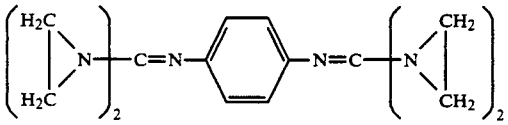

(H-6)

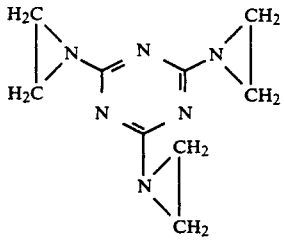

(H-7)

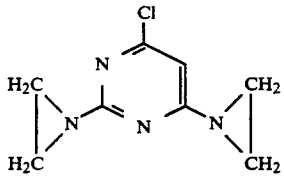

(H-8)

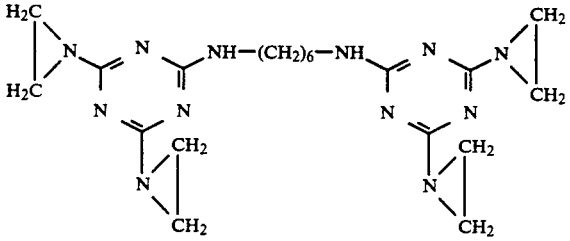

-continued
(H-9)
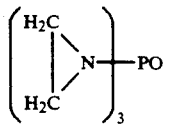
(H-10)
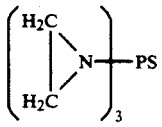
(H-11)
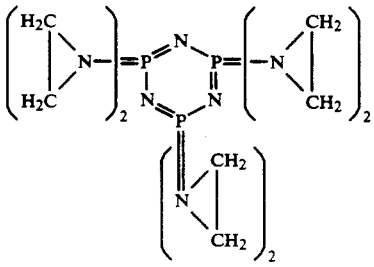
(H-12)
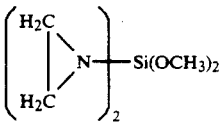
(H-13)
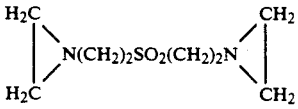
(H-14)
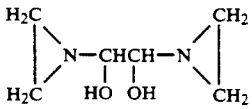
(H-15)
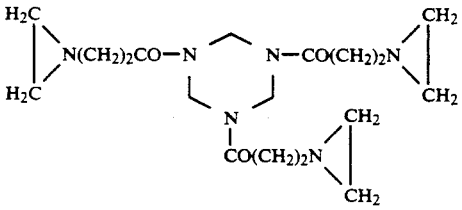
(H-16)
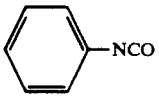
(H-17)
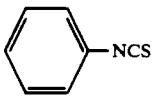
$OCN(CH_2)_6NCO$ (H-18)
$OCN(CH_2)_3S(CH_2)_3NCO$ (H-19)
(H-20)
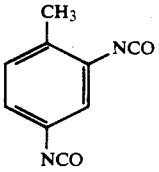

-continued
(H-21)
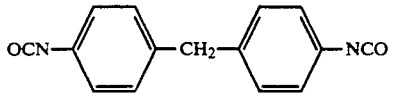
(H-22)
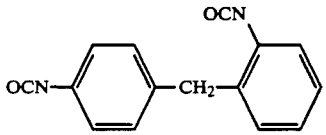
(H-23)
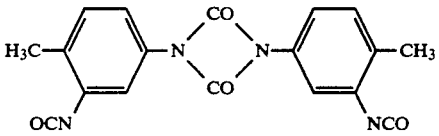
(H-24)
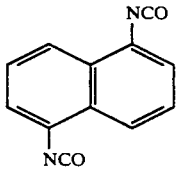
(H-25)
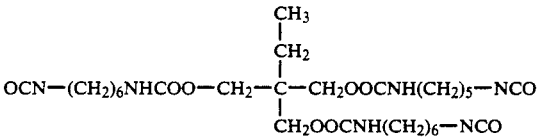
(H-26)
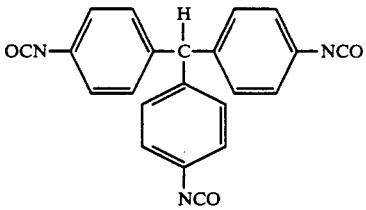
(H-27)
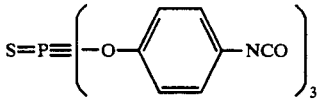
(H-28)
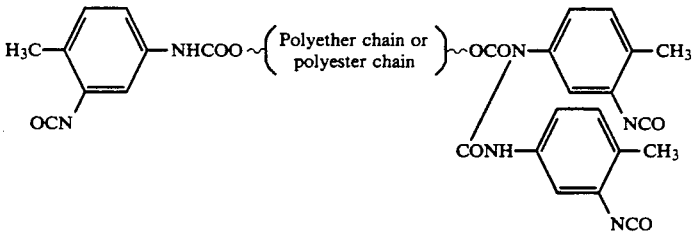
(H-29)
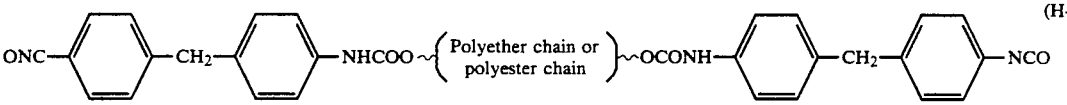

-continued
(H-30)
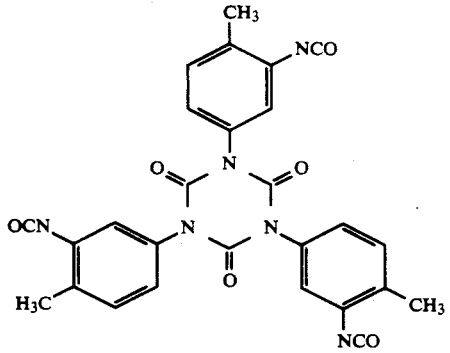
(H-31)
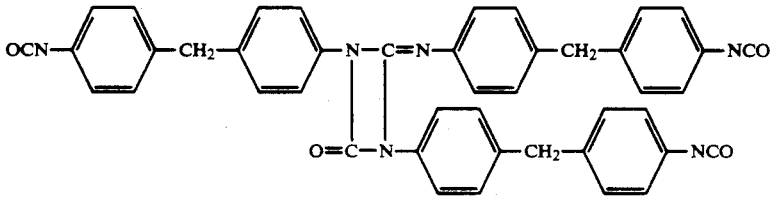
(H-32)
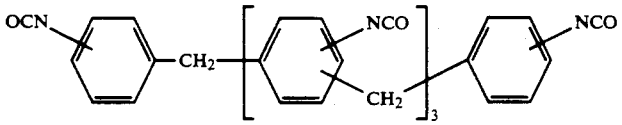
(H-33)
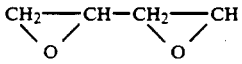
(H-34)
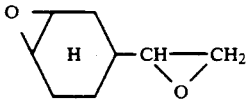
(H-35)
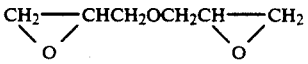
(H-36)
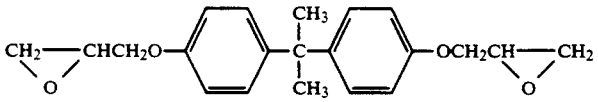
(H-37)
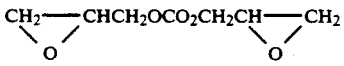
(H-38)
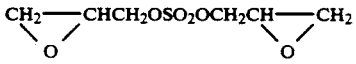
(H-39)
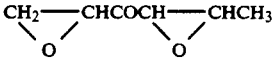
(H-40)
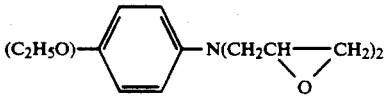
(H-41)
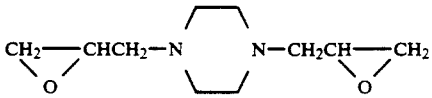

-continued

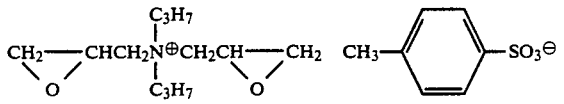

(H-42)

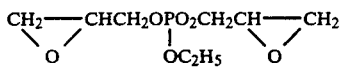

(H-43)

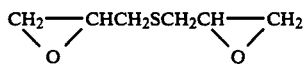

(H-44)

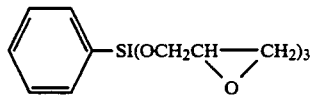

(H-45)

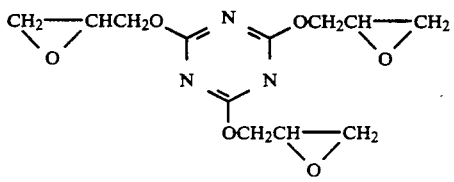

(H-46)

$CH_3SO_3(CH_2)_3SO_2CH_3$ (H-47)

$CH_3SO_3CH_2CH_2OCH_2CH_2OSO_2CH_3$ (H-48)

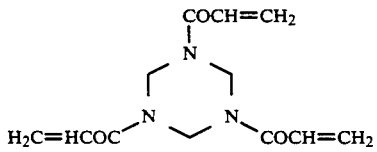

(H-49)

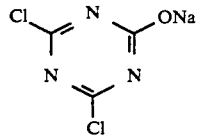

(H-50)

$C(CH_2-SO_2CH=CH_2)_4$ (H-51)

The amount of the hardener is preferably 0.1 to 100 parts by weight, more preferably 0.5 to 50 parts by weight, relative to the amount of the binder resin of the subbing layer.

The image-receiving layer may comprise any substance as long as it has a function of receiving an image of ink or dye during or after heat treatment. The preferred example of such substance is a polymer containing a tertiary amine or a quaternary ammonium salt, in particular, one described in U.S. Pat. No. 3,709,690. Image-receiving layers generally employed in the diffusion transfer method are obtained by applying onto a support a mixture of a polymer containing an ammonium salt, a tertiary amine or the like, gelatin and polyvinyl alcohol and other components. Preferable dye image-receiving substance in the invention is a heat resisting organic high-molecular substance having a glass transition temperature of 40° to 250° C., which is described, for example, in Japanese Patent O.P.I. Publication No. 207250/1982.

Synthetic polymers described in Polymer Handbook, 2nd ed., edited by J. Brandrup and E. H.Immergut (John Wiley & Sons), i.e., polymers having a glass transition temperature of not less than 40° C., are useful as the above-mentioned heat resisting organic high-molecular substance. Of the preceding high-molecular substances, those having a weight average molecular weight of 2,000 to 200,000 are advantageous. These polymeric substances may be used either alone or in combination. Copolymers of these polymers are also usable.

The image-receiving layer most preferably employed in the invention is a layer comprising polyvinyl chloride described in Japanese Patent O.P.I. Publication No. 223425/1984) and a layer comprising polycarbonate and a plasticizer (described in Japanese Patent O.P.I. Publication No. 19138/1985).

Examples of the support, on which the image-receiving layer is provided, include baryta paper, coated paper, resin-coated paper, cloth, glass, metals and plastic films such as a film of polyvinyl chloride or a polyester. In the invention, a pigment such as titanium oxide, barium sulfide, potassium carbonate and talc may be contained in the support or in the surface layer of the support.

In respect of smoothness, strength and resistance to heat, a polyester resin film is most preferable as the support. As the polyester resin, use can be made of polymers obtained by a condensation reaction between aromatic dicarboxylic acids such as terephthalic acid, isophthalic acid, phthalic acid and napthalene dicarboxylic acid and glycols such as ethylene glycol, 1,3-propanediol and 1,4-butanediol. Examples of such polymer include polyethylene terephthalate, polyethylene-2,6-dinapthalate, polypropylene terephthalate, polybutylene terephthalate and copolymers thereof. Of them, polyethylene terephthalate is most preferable, since it is water-proof, smooth, improved in mechanical strength (tensile strength and tearing strength), hardly undergoes heat shrinkage due to improved dimension stability, and resists chemicals during high temperature treatment.

Before applying a coating liquid for forming the subbing layer to the support, it is preferred that the surface of the support be subjected to surface activating treatment. Examples of such treatment include oxidant liquid treatment, ultraviolet ray treatment, electric discharge treatment (e.g. corona discharge treatment), flame treatment and active gas treatment, which are described, for instance, in U.S. Pat. Nos. 2,943,937, 3,475,193, 3,615,557, 3,590,107 and British Patent No. 1,215,234. Of these treatments, corona discharge treatment is preferable in the invention, and in this case, the amount of electric charge emitted is preferably 0.1 to 500 $W/m^2$, more preferably 0.5 to 300 $W/m^2$, per minute.

Combination of a material employed for forming the support and that for forming the image-receiving layer is not limitative, and can be determined according to the application of an image formed on the image-receiving element. For forming the subbing layer, it is preferable to employ a material that exhibits good adhesiveness to both the support and the image-receiving layer.

The subbing layer and the image-receiving layer according to the invention can be coated on the support by the dip method, the roller method, the reverse roll method, the air knife method, the doctor blade method, the spray method, the beads method, the extrusion method, the stretch flow method, the curtain method, or the like.

When the image-receiving element of the invention is employed as the dye-fixing element in the thermal transfer recording process, an ink ribbon is employed in combination with the dye-fixing element. An ink ribbon employed in the evaporation-type thermal image transfer process has a support and provided thereon a layer containing cyan, magenta or yellow dyes (and, if need arises, a black dye or a combination of dyes which assumes black color). The dye-containing layer of an ink ribbon and the thermoplastic resin layer of the image-receiving element of the invention are put together, and thermal energy corresponding to information to be recorded is applied from the backside of the ink ribbon by a thermal head. By this, the dyes contained in the ink ribbon are transferred to the surface or the inside of the thermoplastic resin layer, allowing a dye image to be formed. Details of this thermal transfer recording system are described, for instance, in Japan Electrophotographic Society Report, Vol. 27, No. 2 (1988), pp. 365-371.

Preferred examples of the dye contained in the preceding ink ribbon include Miketon Polyester Yellow YL (manufactured by Mitsui Toatsu Chemicals Inc., C.I. Dispers Yellow 42), Miketon Polyester Yellow 5G (manufactured by Mitsui Toatsu Chemicals Inc., C.I. Dispers Yellow 5), Kayaset Yellow G (manufactured by Nippon Kayaku Co., C.I. Solvent Yellow 77), Kayaset Yellow A-N (manufactured by Nippon Kayaku Co., C.I. Solvent Yellow 125 (S)), PTY-52 (manufactured by Mitsubishi Kasei Corp., C.I. Dispers Yellow 14-1), TPY-56 (manufactured by Mitsubishi Kasei Corp., C.I. Dispers Yellow 3), Miketon Polyester Red BSF (manufactured by Mitsui Toatsu Chemicals, Inc., C.I. Dispers Red 111), Miketon Polyester Red T3B (manufactured by Mitsui Toatsu Chemicals Inc., C.I. Dispers Red 228 (S)), Kayaset Red B (manufactured by Nippon Kayaku Co., C.I. Dispers Red 135), Kayaset Red 126 (manufactured by Nippon Kayaku Co., C.I. Dispers Red 4), PTR-54 (manufactured by Mitsubishi Kasei Corp., C.I. Dispers Red 50), PTR-63 (manufactured by Mitsubishi Kasei Corp., C.I. Dispers Blue 60), Discharge Blue R (manufactured by Mitsui Toatsu Chemicals Inc., C.I. Dispers Blue 106), Mitsui PS Blue 3R (manufactured by Mitsui Toatsu Chemicals Inc., C.I. Dispers Blue 33), PTB-67 (manufactured by Mitsubishi Kasei Corp., C.I. Solvent Blue 90), Kayaset Blue 906 (manufactured by Nippon Kayaku Co., C.I. Solvent Blue 112) and Kayaset Blue 114 (S).

Also usable are basic dyes. Examples include methine (cyanine)-based dyes (e.g. monomethine, dimethine and trimethine-based dyes) such as 3,3L-diethyloxathiacyanine iodide, Astrazone Pink FG (manufactured by Bayer Co., C.I. 48015), 2,2L-carbocyanine (C.I. 808), Atlas phyoxine FF (C.I. Basic Yellow 21), Aizen Katiron Yellow 3GLH (manufactured by Hodogaya Chemical Co., C.I. 480 Kayaset), Aisen Katiron Red 6BH (C.I. 4820); diphenylmethane-based dyes such as Auramine (C.I. 6 Kayaset); triphenylmethane-based dyes such as Malachite Green (C.I. 42000), Brilliant Green (C.I. 42040), Magenta (C.I. 42510), Methyl Violet (C.I. 42535), Crystal Violet (C.I. 684) and Victoria Blue B (C.I. Dispers 045); xanthene-based dyes such as Vinylon G (C.I. 739), Rhodamine (C.I. 45170) and Rhodamine 6G (C.I. 45170); Rhodamine 6G(C.I.45160), acridine-based dyes such as Acridine Yellow G (C.I. 785), Leonine AL (C.I. 46075), Benzoflavin (C.I. 791) and Affin (C.I. 46045); quinoneimine-based dyes such as Neutral Red (C.I. 50040), Astrazone Blue BGE/x125% (C.I. 51005) and Methyl Blue (C.I. 521015); and anthraquinone-based dyes containing an quaternary amine. Also usable are C.I. Dispers Violet 26, C.I. Solvent Blue 63 and C.I. Solvent Blue 36.

The following are the most preferred examples of the dyes employed in the evaporation-type thermal image transfer process:

(Magenta)

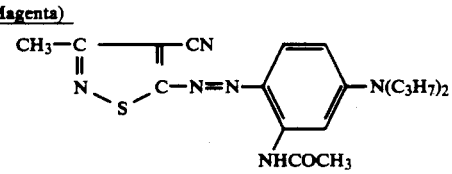

M-1

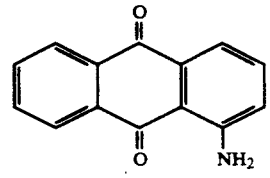

M-2

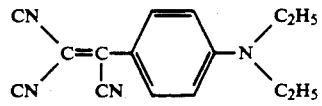

M-3

-continued (Yellow)

Y-1

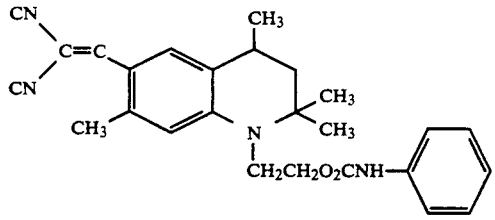

Y-2

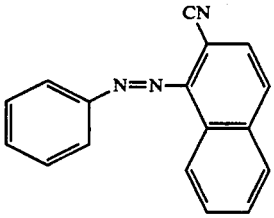

Y-3

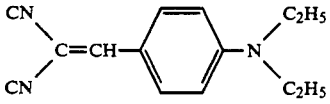

(Cyan)

C-1

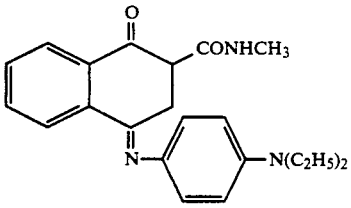

C-2

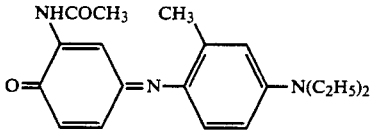

C-3

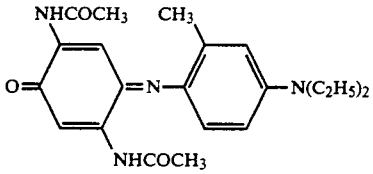

C-4

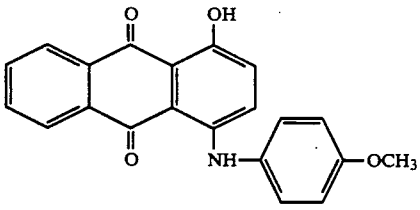

As the binder for sustaining the above-mentioned dyes, use can be made of cellulose resins such as ethylene cellulose, hydroxyethylene cellulose, ethylhydroxy cellulose, hydroxy cellulose, hydroxypropyl cellulose, methyl cellulose, cellulose acetate and cellulose butyrate; and vinyl resins such as polyvinyl butyral, polyvinyl acetal, polyvinyl pyrrolidone, polyester, polyacrylamide and polyphenylene oxide.

A lubricating layer may be provided on the backside of the ink ribbon to prevent it from sticking to a thermal head during heating. The lubricating layer may contain a lubricant and a matting agent such as silica. When the lubricating layer consists of polyethylene terephthalate, the amount of a matting agent is preferably not more than 0.1 g, more preferably not more than 0.02 g, per square meter of the ink ribbon. By using a matting agent in this range of amount, the ink ribbon can be effectively prevented from sticking to a thermal head.

In the melting-type thermal image transfer process, use is made of an ink ribbon comprising a support and provided thereon a layer obtained by dispersing a color material and a hot-melt substance in a binder of a thermoplastic resin. The color material is transferred to the image-receiving element in a manner similar to the evaporation-type thermal image transfer process.

Examples of the color material include carbon black, metals, metal oxides and organic and inorganic pigments.

As the hot-melt substance, preferable are those having a melting point or softening poing of 50° to 120° C. Examples include wax such as petroleum wax (e.g. carbana wax, paraffin wax, microcrystal wax, auricury wax, ester wax, oxidized wax) and mineral wax (e.g. ozocerite, ceresin); higher fatty acids such as palmitic acid and stearic acid; higher alcohols such as palmityl alcohol, stearyl alcohol and behenyl alcohol; higher fatty acid esters such as cetyl palmitate, myricyl palmitate, cetyl stearate and myricyl stearate; amides such as acetamide, propionic acid amide, palmitic acid amide and stearic acid amide; high molecular compounds such as ester gum, rosin-maleic acid resins, rosin-phenol resins, phenol resins, terpene resins, cyclopentadiene resins and aromatic resins; and higher amines such as stearyl amine. These hot-melt substances may be employed either singly or in combination.

Of them, preferred are wax having a melting point of 50° to 100° C., as measured by means of Yanagimoto MJP-2. The content of the hot-melt substance in the ink ribbon is preferably 5 to 40%, more preferably 10 to 30%.

Examples of the thermoplastic resin include resins such as ethylene copolymers, polyamide resins, polyester resins, polyurethane resins, polyolefin resins, acrylic resins, vinyl chloride resins, cellulose resins, rosin resins, ionomer resins and petroleum resins; elastomers such as natural rubber, styrene-butadiene rubber, isoprene rubber, chloroprene rubber and diene-based copolymers; rosin derivatives such as ester gum, rosin-maleic acid resins, rosin-phenol resins and hydrogeneted rosin; and high molecular substances having a softening point of 50° to 150° C., such as phenol resins, terpene resins and aromatic hydrocarbon resins.

A visual image can be obtained by subjecting the image-receiving element of the invention to heat treatment. In this case, a heat-processable light-sensitive material having a support and provided thereon, at least, a silver halide as the light-sensitive component, a reductant, a binder and a dye-providing substance is preferably employed as the image-forming element.

In a preferred embodiment, a dye image formed or released by exposing such heat-processable light-sensitive material to light, followed by heating, is received by the image-receiving element of the invention. The effects of the invention can be manifested most notably in this embodiment.

There are a variety of heat-processable light-sensitive material; examples include those which produce only monochromatic images, those which produce color images, those which require an image-receiving element for image transfer, and those in which an image is remained untransferred, therefore, require no image-receiving element. The image-receiving element of the invention can be applied to any of these heat-processable light-sensitive materials.

Details of these heat-processable light-sensitive materials are described in the summary of the 17th symposium of the Japan Photographic Society (May, 1987), pp 1 to 41. It is preferred that the image-receiving element of the invention be employed in combination with the high temperature transfer type (developed at a temperature of 100° C. or higher) heat-processable silver salt color photographic light-sensitive material described in pages 18 to 27 of the preceding summary.

The outline of this type of heat-processable light-sensitive material is mentioned in the above summary, along with an image-forming process in which this material is used. For details, see Japanese Patent O.P.I. Publication Nos. 144350/1988 and 193844/1989.

The heat-processable light-sensitive material to be employed in a preferred embodiment of the invention has a support and preferably provided thereon three light-sensitive layers (e.g. an infrared-sensitive layer, a red-sensitive layer, a green-sensitive layer) which each contain a polymer coupler as the dye-forming substance, a light-sensitive silver halide, an organic silver salt, p-(N',N'-dialkylaminophenyl)sulfamate as the precursor of a color developing agent, a thermal solvent and gelatin as the binder.

As the polymer coupler, one described in Japanese Patent O.P.I. Publication No. 193844/1989 is preferable. As the light-sensitive silver halide, it is preferable to use one having an average particle size of 0.05 to 0.5 μm. Plural silver halides differing in color sensitivity are generally employed. It is preferable to employ an organic silver salt besides the silver halides. The preferred examples of the organic silver salt are silver benzotriazole, silver 5-methylbenzotriazole, silver benzimidazole, silver benzothiazole, silver acetylide and its derivatives and silver behenide.

As the thermal solvent, preferred is one which is solid at room temperature but melts during heat development. The preferred examples of such thermal solvent are p-tolueneamide, benzamides such as p-n-butoxybenzamide and p-(2-butanoyloxy)ethoxybenzamide, p-n-butoxyphenylurea and phenylurea.

Gelatin is preferable as the binder, but, also usable are gelatin derivatives, polyvinylpyrrolidone and polyvinyl alcohol.

The preceding heat-processable light-sensitive material may contain various known photographic additives according to need.

EXAMPLES

The present invention will be described in more detail according to the following examples, which should not be construed as limiting the scope of the invention.

EXAMPLE 1

Preparation of Ink Ribbon for Evaporation-type Thermal Image Transfer Process According to the process described in Japanese Patent O.P.I. Publication No. 229788/1985, yellow, magenta and cyan ink compositions were prepared using Y-3, M-3 and C-3 dyes. These ink compositions were applied onto an 8 μm-thick polyethylene terephthalate film. The yellow, magenta and cyan ink was printed on this film by a gravure printer, thereby to obtain an ink ribbon for the evaporation-type thermal image transfer process.

Preparation of Image-Receiving Element

On a 175 μm-thick transparent polyethylene terephthalate film which had been subjected to corona discharge treatment, subbing layers as shown in Table 1 were each provided.

Conditions under which subbing layers were provided and ingredients employed are as follows:

| | |
|---|---|
| Electric charge emitted by corona discharge: | 20 $W/m^2/min$ |
| Amount of binder resin: | 0.1 $g/m^2$ |

Type of binder resin:

(B-1): Stylene/butyl acrylate/hydroxyethyl methacrylate ternary copolymer (Tg=30° C.)

(B-2): Polyester resin (Elitel UE-3300, manufactured by Unitika Ltd.)

(B-3): Vinyl chloride/vinyl alcohol/methacrylate/-glycidyl methacrylate copolymer resin A layer of polycarbonate (average polymerization degree: 20,000, manufactured by Mitsubishi Gas Chemicals Co., Inc.) and polyvinyl chloride (average polymerization degree: 800, manufactured by The Shin-Etsu Chemicals Co., Ltd.) was provided on each subbing layer to have a dry thickness of 10 μm. Thus, image-receiving elements (Sample Nos. 1 to 31) were obtained.

Evaluation of Image-Receiving Element

The adhesiveness of the image-receiving layer of each sample to the support immediately after its provision (1) and after the transfer of an image (2) was evaluated by the following method:

(Evaluation Method)

A specimen (5 cm×15 cm) of an image-receiving layer was allowed to stand under the moisture-controlled condition of 20° C. and RH of 50%. Its surface was then scratched with a cutter knife, so that lattice-pattern (the length of each side: about 3 mm) scratches were formed thereon. The number of scratches was 60. Then, an adhesive tape (a cellophane tape manufactured by Nichiban Co., Ltd.) was put over the entire surface of the specimen, and peeled it off at a stretch by a constant level of force.

The adhesiveness of the image-receiving layer to the support was evaluated in terms of the number of scratches removed by the peeling off of the adhesive tape, according to the following criteria:

Criteria of Evaluation

| Rank | Adhesiveness | Number of scratches removed |
|---|---|---|
| A | Excellent (did not peel off) | 0 |
| B | Good (peel off slightly) | 1 to 2 |
| C | Fair (peel off partially) | 3 to 10 |
| D | Poor (peel off considerably) | 11 to 20 |
| E | Extremely poor (peel off completely) | 21 or more |

Image recording was performed on the preceding ink ribbon and image-receiving elements (Sample Nos. 1 to 31), by using a line-type thermal head (8 dot/mm) for the evaporation-type thermal image transfer process.

The conditions under which the thermal head worked are as follows:

| | |
|---|---|
| Voltage: | 6 W/mm$^2$ |
| Pulse width: | 0 to 10 msec |
| Printing cycle: | 33.3 msec/line |

The results obtained are shown in Table 1.

TABLE 1

| Sample No. | Image-receiving element No. | Subbing layer Binder | Hardener cpd. | Hardener Amount | Adhesiveness (1) | Adhesiveness (2) |
|---|---|---|---|---|---|---|
| 1 (Comparative) | 1 | — | — | — | E | E |
| 2 (Comparative) | 2 | B-1 | — | — | D | E |
| 3 (Inventive) | 3 | B-1 | H-49 | 5 wt % relative to amount of binder resin | C | C |
| 4 (Inventive) | 4 | B-1 | H-49 | 25% | C | C |
| 5 (Inventive) | 5 | B-1 | H-50 | 5% | C | C |
| 6 (Inventive) | 6 | B-1 | H-50 | 25% | C | C |
| 7 (Inventive) | 7 | B-1 | H-1 | 5% | B | C |
| 8 (Inventive) | 8 | B-1 | H-1 | 25% | A | B |
| 9 (Inventive) | 9 | B-1 | H-20 | 5% | B | C |
| 10 (Inventive) | 10 | B-1 | H-20 | 25% | A | B |
| 11 (Inventive) | 11 | B-1 | H-38 | 5% | B | C |
| 12 (Inventive) | 12 | B-1 | H-38 | 25% | A | B |
| 13 (Inventive) | 13 | B-1 | H-48 | 5% | C | C |
| 14 (Inventive) | 14 | B-1 | H-48 | 25% | B | C |
| 15 (Comparative) | 15 | B-2 | — | — | D | D-E |
| 16 (Inventive) | 16 | B-2 | H-49 | 5% | C | C |
| 17 (Inventive) | 17 | B-2 | H-49 | 25% | C | C |
| 18 (Inventive) | 18 | B-2 | H-1 | 5% | B | C |
| 19 (Inventive) | 19 | B-2 | H-1 | 25% | A | A |
| 20 (Inventive) | 20 | B-2 | H-20 | 5% | A | B |
| 21 (Inventive) | 21 | B-2 | H-20 | 25% | A | A |
| 22 (Inventive) | 22 | B-2 | H-38 | 5% | A | B |
| 23 (Inventive) | 23 | B-2 | H-38 | 25% | A | A |
| 24 (Inventive) | 24 | B-2 | H-48 | 5% | C | C |
| 25 (Inventive) | 25 | B-2 | H-48 | 25% | A | A |
| 26 (Comparative) | 26 | B-3 | — | — | D | E |
| 27 (Inventive) | 27 | B-3 | H-49 | 25% | B | C |
| 28 (Inventive) | 28 | B-3 | H-1 | 25% | A | B-A |
| 29 (Inventive) | 29 | B-3 | H-20 | 25% | A | A |
| 30 (Inventive) | 30 | B-3 | H-38 | 25% | A | A |
| 31 (Inventive) | 31 | B-3 | H-48 | 25% | C | B |

EXAMPLE 2

An image-receiving element was prepared in substantially the same manner as in Example 1, except that the transparent polyethylene terephthalate film support (thickness: 175 μm) was replaced by a white polyethylene terephthalate film support containing barium sulfate (thickness: 175 μm).

The obtained sample was subjected to the same evaluation as performed in Example 1. The image-receiving layer of this sample was found to have good adhesiveness to the support.

EXAMPLE 3

Preparation of Emulsion

Various emulsions were prepared by the following method:

Preparation of Silver Iodobromide

A silver iodobromide emulsion was prepared by using the following five solutions. As the seed emulsion, a silver iodobromide seed emulsion having a silver iodide content of 2 mol % and an average particle size of 0.09 μm was used (the particle size as referred to herein means the length of one side of a cube having the same volume).

| | |
|---|---|
| (Solution A) | |
| Ossein gelatin | 2.1 g |
| 10% Ethanol solution of sodium polyisopropylene polyethyleneoxy disuccinate | 5.0 ml |
| 28% Aqueous ammonia | 29 ml |
| Seed emulsion | Equivalent to 0.26 mol |
| Deionized water was added to make the total quantity | 1705 ml |
| (Solution B) | |
| Ossein gelatin | 6.0 g |
| KBr | 200.0 g |
| KI | 5.8 g |
| Deionized water was added to make the total amount | 500 ml |
| (Solution C) | |
| $AgNO_3$ | 246.3 g |
| 28% Aqueous ammonia | 200.9 ml |
| Deionized water was added to make the total amount | 414 ml |
| Solution D | |
| 50% Aqueous KBr solution | an amount necessary for controlling pAg |
| Solution E | |
| 56% Aqueous acetic acid solution | an amount neccesary for controlling pH |

Using the stirrer described in Japanese Patent O.P.I. Publication Nos. 92523/1982 and 92524/1982, Solutions B and C were added to Solution A at 40° C. at equal flow rates by the double-jet method.

During the addition, pH and pAg were maintained at 8.0 and 9.0, respectively, by controlling the flow rates of Solutions D and E by means of roller tube pumps capable of changing flow rate. The addition of Solution B and that of Solution C were each performed at a maximum allowable rate over which small particles begin to be formed (critical rate).

When the amount of Solution C added reached 288 ml, a $2\times10^{-6}$ mol $K_2IrCl_6$(IV) aqueous solution was began to be added. The addition of this solution was stopped when all of Solution C was added.

Then, pAg and pH were adjusted respectively to 10.4 and 6.0, followed by desalting according to a normal method. The mixture was then dispersed in an aqueous solution containing 45.7 g of ossein gelatin. Distilled water was added to make the total amount of the mixture 1200 ml. Then, pAg and pH were adjusted to 8.5 and 5.8, respectively, at 40° C., thereby to obtain a silver iodobromide emulsion with a silver iodide content of 2 mol%, and containing $1\times10-6$ mol per mol silver of iridium ions. Electron microscopic examination revealed that this emulsion is a monodispersed emulsion consisting of cubic particles with an average particle size of 0.17 μm.

Preparation of Infrared-Sensitive Silver Iodobromide Emulsion

The following components were added to 360 ml of the above-obtained silver iodobromide emulsion to perform chemical and spectral sensitization.

| | |
|---|---|
| Sensitizing dye (a): 0.1% methanol solution | 48.0 ml |
| Sensitizing dye (b): 0.1% methanol solution | 46.0 ml |

-continued

| | |
|---|---|
| Sodium thiosulfate | 13.5 ml |

Then, the following components were added to make the emulsion stabilized, and deionized water was added to make the total amount 540 ml.

| | |
|---|---|
| 4-Hydroxy-6-methyl-1,3,3a,7-tetrazaindene | 0.5 g |
| Antifoggant (ST-1) | 0.4 g |
| Gelatin | 7.2 g |

Then, the following components were added to make the emulsion stabilized, and deionized water was added to make the total amount 470 ml.

| | |
|---|---|
| 4-Hydroxy-6-methyl-1,3,3a,7-tetrazaindene | 0.5 g |
| Antifoggant ST-1 | 0.4 g |
| Gelatin | 7.2 g |

Sensitizing dye (c)

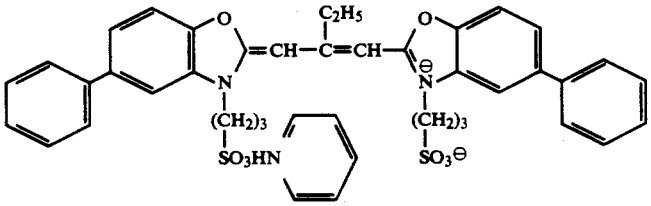

Antifoggant (ST-1)

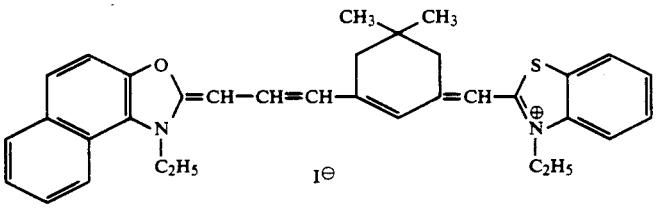

Sensitizing dye (a)

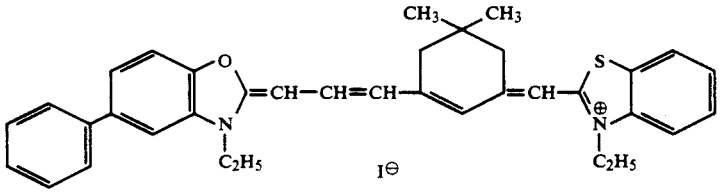

Sensitizing dye (b)

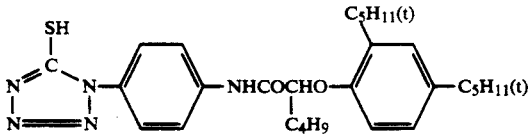

Antifoggant (ST-1)

Preparation of Green-Sensitive Silver Iodobromide Emulsion

The following components were added to 360 ml of the above-obtained silver iodobromide emulsion to perform chemical and spectral sensitization.

| | |
|---|---|
| Sensitizing dye (c): 1% methanol solution | 36.0 ml |
| Sodium thiosulfate | 6.0 mg |
| Ammonium thiocyanate | 11.4 mg |
| Chloroaurate | 1.1 mg |

Preparation of Red-Sensitive Silver Iodobromide Emulsion

The following components were added to 360 ml of the above-obtained silver iodobromide emulsion to perform chemical and spectral sensitization.

| | |
|---|---|
| Sensitizing dye (d): 1% methanol solution | 38.0 ml |
| Sensitizing dye (e): 1% methanol solution | 3.8 ml |

| | |
|---|---|
| Sodium thiosulfate | 10.3 mg |

Then, the following components were added to make the emulsion stabilized, and deionized water was added to make the total amount 470 ml.

| | |
|---|---|
| 4-Hydroxy-6-methyl-1,3,3a,7-tetrazaindene | 0.5 g |
| Antifoggant ST-1 | 0.4 g |
| Gelatin | 7.2 g |

Sensitizing dye (d)

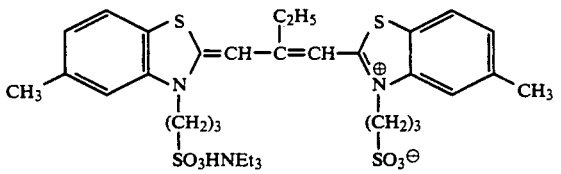

Sensitizing dye (e)

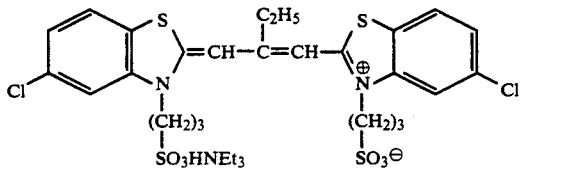

Preparation of Heat-Processable Light-Sensitive Material-1

A heat-processable light-sensitive material having the layer structure as shown in Table 2 was prepared. The amounts of silver halides and silver benzotriazole were each converted to the amount of silver, and expressed in an amount per square meter of the light-sensitive material.

TABLE 2

| | | |
|---|---|---|
| Protective layer | Gelatin | 0.1 g |
| | Silica powder | 0.4 g |
| | Thermal solvent | 0.5 g |
| | U.V. absorber | 0.2 g |
| | Reductant | 0.2 g |
| Infrared-sensitive layer | Infrared-sensitive silver iodobromide emulsion | 0.31 g |
| | Reductant | 0.38 g |

TABLE 2-continued

| | | |
|---|---|---|
| | Gelatin | 1.7 g |
| | Silver benzotriazole | 0.43 g |
| | Dye-forming polymer (1) | 1.1 g |
| | Thermal solvent | 2.1 g |
| | DOP | 0.6 g |
| 2nd interlayer | Gelatin | 1.4 g |
| | Reductant | 0.35 g |
| | U.V. absorber | 0.2 g |
| | DOP | 0.1 g |
| Green-sensitive layer | Green-sensitive silver iodobromide emulsion | 0.27 g |
| | Silver benzotriazole | 0.46 g |
| | Gelatin | 1.3 g |
| | Reductant | 0.26 g |
| | Dye-forming polymer (2) | 0.7 g |
| | Thermal solvent | 2.0 g |
| | DOP | 0.2 g |
| 1st interlayer | Gelatin | 1.6 g |
| | Reductant | 0.4 g |
| Red-sensitive layer | Red-sensitive silver iodobromide emulsion | 0.43 g |
| | Silver benzotriazole | 0.61 g |
| | Gelatin | 1.6 g |
| | Reductant | 0.32 g |
| | Dye-forming polymer (3) | 1.2 g |
| | Thermal solvent | 2.1 g |
| | DOP | 0.3 g |
| Gelatin subbing layer | Gelatin | 1.0 g |
| | Thermal solvent | 0.5 g |
| | Reductant | 0.2 g |
| | DOP | 0.1 g |
| Support | 180 μm-thick transparent PET film support | |
| Backing layer | Gelatin | 1.8 g |
| | Matting agent (acrylate-based latex particles: particle size 4 to 8 μm) | 0.1 g |
| | Black colloidal silver | 0.2 g |

The structure of each compound shown in Table 2 is shown below:

Dye-forming polymer (1)

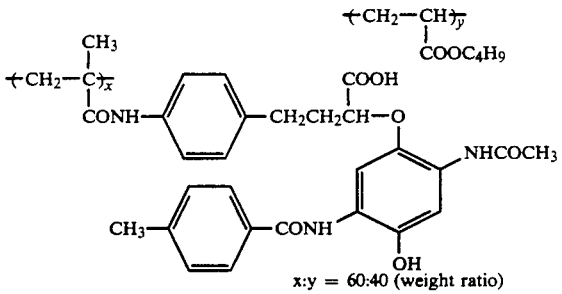

x:y = 60:40 (weight ratio)

Dye-forming polymer (2)

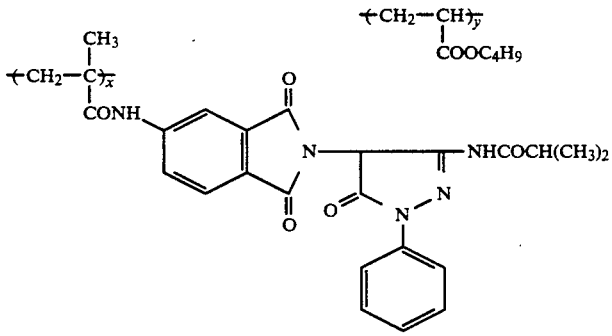

x:y = 50:50 (weight ratio)

-continued

Dye-forming polymer (3)

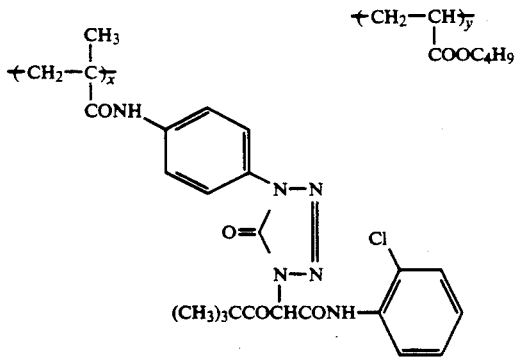

x:y = 70:30 (weight ratio)

Heat solvent

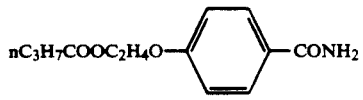

Reducer

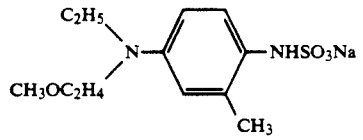

(A)

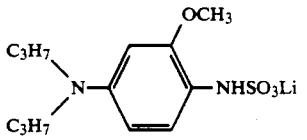

(B)

x:y = 70:30 (weight ratio)

Di-(2-ethylhexyl)phthalate

DOP

Preparation of Image-Receiving Elements (Sample Nos. 32 to 57)

Subbing layers as shown in Table 3 were each provided on a 100 μm-thick transparent polyethylene terephthalate film that had been subjected to corona discharge treatment.

The conditions under which the subbing layers were provided and the ingredients employed are as follows:

Amount of electric charge emitted by corona discharge:

50 W/m²/min

Amount of binder resin: 3.0 g/m²

Type of binder resin: Polyester resin (Vylon 200, manufactured by Toyobo Co., Ltd.)

Each subbing layer was provided by a process comprising dissolving the ingredients in methyl ethyl ketone, applying the obtained coating liquid to the support by means of an extruder, followed by drying at 40° to 60° C.

Then, an image-receiving layer of the following composition was provided on each subbing layer, thereby to obtain image-receiving elements (Sample Nos. 32 to 57).

Composition of image-receiving layer

| | |
|---|---|
| Polyvinyl chloride (polymerization degree: 500) | 12 g |
| DOP | 0.6 g |
| The preceding thermal solvent | 1.0 g |
| Development accelerator-1 | 0.3 g |
| Image stabilizer-1 | 0.8 g |
| Image stabilizer-2 | 0.4 g |
| Image stabilizer-3 | 0.4 g |

Dye-forming polymer (1)

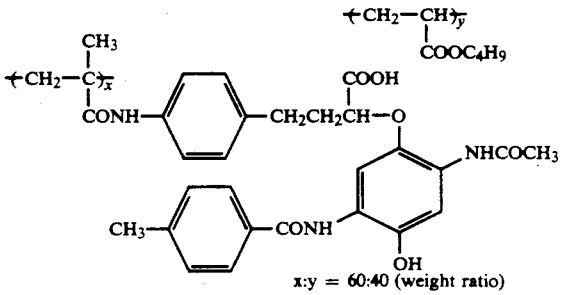

x:y = 60:40 (weight ratio)

-continued

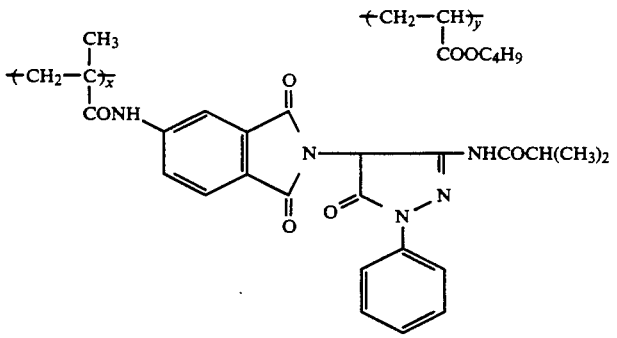

x:y = 50:50 (weight ratio)

Dye-forming polymer (2)

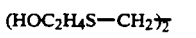

Development accelerator-1

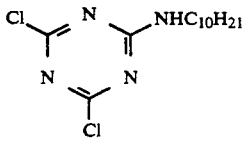

Image stabilizer-1

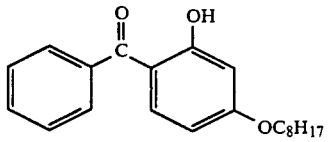

Image stabilizer-2

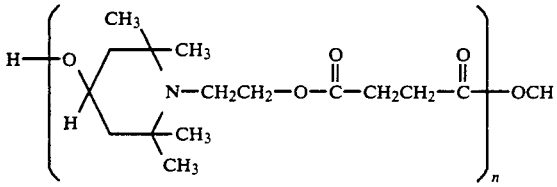

n ≈ 20

Image stabilizer-3

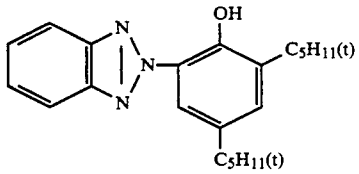

UV absorbent

The obtained heat developing light-sensitive material-1 and each of the image-receiving elements (Sample Nos. 32 to 57) were exposed to light, followed by heat-processing by means of the heat-developing device described in Japanese Patent O.P.I. Publication No. 193739/1989, FIG. 1. Observation was made to examine whether the development was performed uniformly or not. Evaluation was made according to the following criteria:

| Criteria of Evaluation | |
|---|---|
| Rank | Uniformity of Development |
| a | Completely uniform |
| b | Ununiformity was observed partially |
| c | Ununiformity was observed over the entire surface of a film |

Each of the image-receiving elements was evaluated for the adhesiveness of the image-receiving layer to the support in the same manner as in Example 1. The results obtained are shown in Table 3.

TABLE 3

| Sample No. | Image-receiving element No. | Subbing layer Binder | Hardener cpd. | Hardener Amount | Development temperature | Adhesiveness (1) | Adhesiveness (2) | Uniformity of development |
|---|---|---|---|---|---|---|---|---|
| 32 (Comparative) | 32 | — | — | — | 140° | E | E | c |
| 33 (Comparative) | 33 | B-1 | — | — | 140° | D | E | c |
| 34 (Inventive) | 34 | B-1 | H-49 | 25 wt % | 140° | C | C | b |

TABLE 3 -continued

| Sample No. | Image-receiving element No. | Subbing layer Binder | Hardener cpd. | Hardener Amount | Development temperature | Adhesiveness (1) | Adhesiveness (2) | Uniformity of development |
|---|---|---|---|---|---|---|---|---|
| 35 (Inventive) | 35 | B-1 | H-50 | 25 wt % | 140° | C | C | b |
| 36 (Inventive) | 36 | B-1 | H-9 | 25 wt % | 140° | B | B-C | a |
| 37 (Inventive) | 37 | B-1 | H-26 | 25 wt % | 140° | B | B-C | a |
| 38 (Inventive) | 38 | B-1 | H-46 | 25 wt % | 140° | B | B-C | a |
| 39 (Inventive) | 39 | B-1 | H-48 | 25 wt % | 140° | C | C | a |
| 40 (Comparative) | 40 | B-4 | — | — | 140° | D | E | c |
| 41 (Inventive) | 41 | B-4 | H-49 | 25 wt % | 140° | B | C | b |
| 42 (Inventive) | 42 | B-4 | H-50 | 25 wt % | 140° | C | C | b |
| 43 (Inventive) | 43 | B-4 | H-9 | 25 wt % | 140° | A | B | a |
| 44 (Inventive) | 44 | B-4 | H-26 | 25 wt % | 140° | A | B | a |
| 45 (Inventive) | 45 | B-4 | H-46 | 25 wt % | 140° | A | B | a |
| 46 (Inventive) | 46 | B-4 | H-48 | 25 wt % | 140° | B | C | b |
| 47 (Comparative) | 47 | B-3 | — | — | 140° | D | E | c |
| 48 (Inventive) | 48 | B-3 | H-49 | 5 wt % | 140° | C | C | b |
| 49 (Inventive) | 49 | B-3 | H-49 | 25 wt % | 140° | B | C | b |
| 50 (Inventive) | 49 | B-3 | H-49 | 25 wt % | 160° | B | C | b |
| 51 (Inventive) | 50 | B-3 | H-9 | 5 wt % | 140° | A | B | a |
| 52 (Inventive) | 51 | B-3 | H-9 | 25 wt % | 140° | A | A | a |
| 53 (Inventive) | 51 | B-3 | H-9 | 25 wt % | 160° | A | A-B | a |
| 54 (Inventive) | 52 | B-3 | H-26 | 5 wt % | 140° | A | B | a |
| 55 (Inventive) | 53 | B-3 | H-26 | 25 wt % | 140° | A | A | a |
| 56 (Inventive) | 53 | B-3 | H-26 | 25 wt % | 160° | A | A | a |
| 57 (Inventive) | 54 | B-3 | H-46 | 5 wt % | 140° | A | B | a |
| 58 (Inventive) | 55 | B-3 | H-46 | 25 wt % | 140° | A | A | a |
| 59 (Inventive) | 55 | B-3 | H-46 | 25 wt % | 160° | A | A | a |
| 60 (Inventive) | 56 | B-3 | H-48 | 5 wt % | 140° | B | C | b |
| 61 (Inventive) | 57 | B-3 | H-48 | 25 wt % | 140° | A | B | a |
| 62 (Inventive) | 57 | B-3 | H-48 | 25 wt % | 160° | A | C | b |

*Amount relative to the amount of the binder resin (wt %)

As is evident from the results shown in Table 3, the image-receiving elements of the invention allowed development to be performed uniformly due to good adhesion between the image-receiving layer and the support. Further, in the case of the image-receiving elements of the invention, adhesion between the image-receiving layer and the support was maintained even after the heat transfer of an image. These effects could be manifested most notably when ethyleneimine-compounds, isocyanate-based compounds and epoxy-based compounds were employed as the hardener.

What is claimed is:

1. An image-receiving element for receiving a dye image formed or released by heating, wherein said element comprises a support having a subbing layer and an image-receiving layer provided thereon in this sequence; and said subbing layer contains a binder resin and a hardener.

2. An image-receiving element of claim 1, wherein the surface of said support is subjected to corona discharge treatment prior to providing said subbing layer on said support.

3. An image-receiving element of claim 1, wherein said support comprises a polyester resin.

4. An image-receiving element of claim 1, wherein said hardener is at least one selected from ethyleneimines, isocyanates and epoxides.

5. An image-receiving element of claim 1, wherein said hardener is contained in an amount of 0.5 to 50 wt. % based on weight of said binder resin.

6. An image-receiving element of claim 1, wherein said image-receiving layer contains a binder which comprises hydrophobic polymer.

7. An image-receiving element of claim 6, wherein said hydrophobic polymer is poyvinyl chloride or polycarbonate.

8. An image-receiving element of claim 1, wherein said dye image is formed or released by light-exposing and heating a heat-processable light-sensitive material comprising a support having thereon a light-sensitive silver halide, a reducing agent, a binder and a dye-providing material.

9. An image-receiving element for receiving a dye image formed or released by heating, wherein said element comprises a polyester resin support having a subbing layer and an image-receiving layer containing polyvinyl chloride provided on said support in this sequence, in which the surface of said support is subjected to corona discharge treatment prior to providing said subbing layer and said subbing layer contains a binder resin and an isocyanate hardener.

* * * * *